United States Patent [19]

Collaris et al.

[11] 4,016,307

[45] Apr. 5, 1977

[54] METHOD OF SELECTIVELY METALLIZING THE DISPLAY SCREEN OF A CATHODE-RAY TUBE AND CATHODE-RAY TUBE MANUFACTURED BY SAID METHOD

[75] Inventors: Maria Antonius Alphonsus Andreas Collaris; Antonius Wilhelmus Cornelis van Kemenade; Henricus Antonius Debruijn; Mathieu Willem Maria Snijders, all of Eindoven, Netherlands

[73] Assignee: U.S. Philips Corporation, New York, N.Y.

[22] Filed: Jan. 14, 1976

[21] Appl. No.: 649,141

[30] Foreign Application Priority Data

Jan. 20, 1975 Netherlands ..... 7500616

[52] U.S. Cl. ..... 427/54; 427/64; 427/68; 427/123; 427/125; 427/304; 427/305

[51] Int. Cl.[2] ..... B05D 5/12; B05D 3/06

[58] Field of Search ..... 427/64, 125, 123, 304, 427/305, 54, 68

[56] References Cited

UNITED STATES PATENTS

| | | | |
|---|---|---|---|
| 3,681,110 | 8/1972 | Feldstein | 427/68 |
| 3,821,009 | 6/1974 | Lerner et al. | 427/64 |
| 3,942,983 | 3/1976 | DiBlas et al. | 427/304 |

*Primary Examiner*—Cameron K. Weiffenbach
*Attorney, Agent, or Firm*—Frank R. Trifari; Norman N. Spain

[57] ABSTRACT

A method of selectively metallizing only the phosphor regions of a pattern of phosphor regions and uncovered regions on a window portion of a cathode-ray tube. An electroless plating bath is used. A photosensitive layer which is exposed via the window portion prevents the phosphor grains from being enveloped by a metal layer.

4 Claims, No Drawings

METHOD OF SELECTIVELY METALLIZING THE DISPLAY SCREEN OF A CATHODE-RAY TUBE AND CATHODE-RAY TUBE MANUFACTURED BY SAID METHOD

The invention relates to a method of selectively metallizing only the phosphor regions of a pattern of phosphor regions and uncovered regions on a window portion of a cathode-ray tube. The invention also relates to a cathode-ray tube manufactured by such a method.

Such a method is described in the not yet published Dutch Patent Application 7,310,738 (PHN. 7037) in the name of Applicant. With this method a cathode-ray tube for displaying coloured pictures is obtained which need not be provided with light-absorbing material between the phosphor regions in order to increase the contrast of the displayed picture. In such a tube said light-absorbing material is not necessary because the contrast is improved in a different manner. The reflecting metal layer with which the display screen is generally coated on the rear side, does not extend between the phosphor regions in such a tube, so that ambient light which impinges on the display screen between the phosphor regions is not reflected and which would decrease the contrast, but is absorbed in the tube via the window portion. An additional advantage is that thermal radiation can leave the tube in the reverse direction so that a lower operating temperature is achieved with all the associated advantages, for example, a smaller deformation of the shadow mask and hence fewer colour defects by mislanding of the electron beams However, the method described in the Dutch Patent Application 7,310,738 is rather complicated because first a continuous reflective metal lqyer is provided which is then removed selectively from the regions between the phosphor regions by etching. For said selective removal of the non-desired parts of the reflective metal layer, three exposures are necessary which must register accurately with the phosphor regions. Such exposures present a major problem in mass production because the colour selection electrode (shadow mask) must first be mounted again accurately in the window portion and has to be removed again after the exposure.

It is the object of the invention to provide a simple method of selectively metallizing only the phosphor regions of a pattern of phosphor regions and uncovered regions on a window portion of a cathode-ray tube. The particular object of the invention is to provide such a method in which no critical exposure in registration with the pattern of phosphor regions is necessary.

For that purpose, a method according to the invention comprises the following steps:

a. a photosensitive layer which becomes insoluble in a solvent as a result of exposure to actinic radiation is provided over the said pattern, b. the photosensitive layer is exposed to actinic radiation via the window portion, c. the photosensitive layer is developed by removing the parts of the layer which have remained soluble from the phosphor regions by means of the solvent, d. the pattern is treated with a solution comprising ions of a metal from the group Pd, Pt, Au, Ag, and Cu, e. the pattern is metallized with a metal from the group Ni, Ag, Co, Sn, Cu and Au in an electroless plating bath, f. the remaining parts of the photosensitive layer are removed by means of a thermal treatment.

It is to be noted that electroless plating of electrically non-conductive articles is known. For this purpose reference may be made, for example, to U.S. Patent Spec. No. 3,674,550. However, such known methods cannot be applied to the selective metallisation of only the phosphor regions of a pattern of phosphor regions and uncovered regions on, for example, a glass substrate, since the metal would deposit both the phosphor and on the glass. According to the invention, only a metal deposit on the phosphor is obtained by omitting the known sensitisation of the surface with a solution comprising tin ions. It has been found that in the subsequent activation (rendering catalytic) of the surface (step *d*), nuclei of Pd, Pt, Au, Ag or Cu are nevertheless formed but only on the phosphor, which activation must sometimes be stimulated by means of ultraviolet light, dependent on the type of phosphor and for reasons which are not yet quite understood. In order to prevent the individual phosphor grains from being enveloped by palladium nuclei, so that in the subsequent electroless plating the grains would all around be provided with a metal layer, which of course is not the intention, the said photosensitive layer is used. Said photosensitive layer is exposed via the window portion and since the phosphor regions pass only a little actinic radiation, the photosensitive layer remains soluble only at the surface of the phosphor regions and is then removed from the surface of the phosphor regions by means of the solvent.

A method according to the invention may be carried out with all electroless plating baths known for Ni, Ag, Co, Sn, Cu and Au in which the surface, as is known, can be catalysed with Pd, Pt, Au, Ag or Cu nuclei. Particularly good results have been obtained with Pd nuclei and an Ni deposit. A method according to the invention may furthermore be carried out with a large number of known photosensitive layers which become insoluble by exposure to actinic radiation. Particularly good results have been obtained with photosensitive layers which are water-repellent and non-photoconductive so that the formation of palladium nuclei, in particular in the already mentioned stimulating exposure, is avoided entirely.

The invention will now be described in greater detail with reference to the following description of the metallisation of a pattern of phosphor regions and uncovered regions on a glass window portion of a colour television display tube. The phosphor regions have previously been provided on the window portion by an arbitrary known method and have, for example, the shape of lines which are arranged in triplets of red-, green-, and blue-luminescing phosphor regions, respectively. Europium-activated yttrium oxysulphide may be used as a red-luminescing phosphor. Copper and aluminium-activated zinc cadmium sulphide may be used as a green-luminescing phosphor. Silver-activated zinc sulphide may be used as a blue-luminescing phosphor. The manner in which the phosphors are provided on the window portion are of no significance for the present invention. The type of phosphor used is not of great importance for the invention, although, as will become apparent hereinafter, a stimulating exposure is necessary for some phosphors to form Pd, Pt, Au, Ag or Cu nuclei.

A photosensitive layer which becomes insoluble in a certain solvent as a result of exposure to actinic radiation is provided over the pattern of phosphor regions and uncovered regions. For this purpose may be used many types of photolacquer, in particular those which are water-repellent and non-photoconductive. An example of such a lacquer has the following composition:

700 ml of tertiary butanol
300 ml of methyl glycol acetate
52 g of polyvinyl butyral
13 g benzyldimethyllaurylammonium bichromate 60 mg benzotriazole
76 mg sodium m-nitrobenzenesulphonate.

The developing liquid for said photolacquer, that is the solvent in which the photolacquer becomes insoluble after the exposure, is ethylene glycol (100%).

The photosensitive layer is dried and is then exposed, via the window portion, to ultraviolet radiation for a few minutes. The ultraviolet radiation hence reaches the photosensitive layer only after passing through the glass of the window portion. This has for its result that the photosensitive layer becomes insoluble between the phosphor regions as well as in the cavities between the phosphor grains on the side of the glass. On the phosphor regions the photosensitive layer does not become insoluble because the ultraviolet radiation does not penetrate so far as a result of the absorption thereof in the phosphor.

The exposed photosensitive layer is then developed with the already mentioned developing liquid (ethylene glycol) and is then rinsed with water and dried. The photosensitive layer is thereby removed from the surface of the phosphor regions but remains present in an insoluble state between the phosphor regions and in the cavities between the phosphor grains.

The surface of the phosphor regions is then catalysed by treating the window portion with an aqueous solution comprising 2 g of palladium chloride and 20 ml of concentrated hydrochloric acid per litre of water to which a small quantity of a surface-active material has been added as a wetting agent. It is then found that, in spite of the fact that the substrate has not been sensitized, palladium nuclei form on the phosphor regions, but not on the regions of the glass covered only with the photosensitive layer. It is found that the formation of nuclei can be stimulated in particular for the red-luminescing phosphor used (europium-activated yttrium oxysulphide) by a short exposure to ultra-violet light. This exposure takes place on the side of the window portion on which the phosphor pattern is present, It has been found that the formation of nuclei does not take place either on the phosphor grains or within the phosphor regions since the cavities in the porous phosphor regions are filled with the parts of the photosensitive layer which have remained after the development.

After rinsing with water, the window portion is treated with a 0.4 molar solution of glycocol (aminoacetic acid) in water. This solution complexes and removes palladium chloride, if any, adsorbed on the photosensitive layer so as to prevent this from being reduced to palladium nuclei in the subsequent electroless plating bath.

After rinsing with water the phosphor pattern is then subjected to electroless nickel-plating in a bath of known composition, for example, a bath containing per liter of water:

| | | |
|---|---|---|
| $NiSO_4.7H_2O$ | 19.2 | g |
| acetic acid | 28.0 | g |
| NaOH | 11.6 | g |
| $NaH_2PO_2.H_2O$ | 25.5 | g |
| Lead acetate | 3.6 | mg. |

This bath is used at a temperature of 95° C. An electroless nickel-plating bath which is used at a temperature of 25° C comprises per liter of water:

| | | |
|---|---|---|
| $NiSO_4.6H_2O$ | 25 | g |
| $Na_4P_2O_7.10H_2O$ | 50 | g |
| $NH_4OH$ (58%) | 22.5 | ml |
| $NaH_2PO_2.H_2O$ | 25 | g. |

The window portion is finally rinsed with warm water (70° C) and fired in known manner for removing the photosensitive layer.

Although the invention has been explained with reference to a method of selectively metallizing the phosphor regions of a colour television display tube, the invention may of course also be used for the selective metallization of any surface which comprises active regions which are separated from each other.

What is claimed is:

1. A method of selectively metallizing only the phosphor regions of a pattern of phosphor regions and uncovered regions on a window portion of a cathode-ray tube, characterized in that:

a. a photosensitive layer which becomes insoluble in a solvent as a result of exposure to actinic radiation is provided over said pattern,
b. the photosensitive layer is exposed to actinic radiation via the window portion,
c. the photosensitive layer is developed by removing the parts of the layer which have remained soluble from the phosphor regions by means of the solvent,
d. the pattern is treated with a solution containing ions of a metal selected from the group consisting of Pd, Pt, Au, Ag and Cu,
e. the pattern is metallized with a metal selected from the group consisting of Ni, Ag, Co, Sn, Cu and Au in an electroless plating bath,
f. the remaining parts of the photosensitive layer are removed by means of a thermal treatment.

2. A method as claimed in clain 1, characterized in that the metal of step d) is Pd and the metal of step e) is Ni.

3. A method as claimed in claim 1, characterized in that the photosensitive layer is water-repellent and non-photoconductive.

4. A method as claimed in claim 1, characterized in that in step d) the pattern is exposed to actinic radiation while the pattern is still in contact with the said solution.

* * * * *